US006619932B2

(12) United States Patent
Murata

(10) Patent No.: US 6,619,932 B2
(45) Date of Patent: Sep. 16, 2003

(54) RESTARTING DEVICE OF A PUMP CHANGE-OVER VALVE WHICH INDUCES A PRESSURE DIFFERENCE WITHIN THE PUMP CHANGE-OVER VALVE TO REMOVE THE LATTER FROM AN INTERMEDIATE STALLED POSITION

(75) Inventor: Shigeru Murata, Tokyo (JP)

(73) Assignee: Yamada T.S. Co. Ltd., Tokyo (JP)

( * ) Notice: Subject to any disclaimer, the term of this patent is extended or adjusted under 35 U.S.C. 154(b) by 0 days.

(21) Appl. No.: 10/051,275

(22) Filed: Jan. 22, 2002

(65) Prior Publication Data

US 2002/0098095 A1 Jul. 25, 2002

(30) Foreign Application Priority Data

Jan. 23, 2001 (JP) ..... 2001-014405

(51) Int. Cl.[7] ..... F04B 45/053

(52) U.S. Cl. ..... 417/395; 392/393; 392/394; 392/521

(58) Field of Search ..... 417/392, 393, 417/394, 395, 521

(56) References Cited

U.S. PATENT DOCUMENTS 3,741,689 A * 6/1973 Rupp ..... 417/393
3,838,946 A * 10/1974 Schall ..... 417/395
4,381,180 A * 4/1983 Sell ..... 417/393
4,674,958 A * 6/1987 Igarashi et al. ..... 417/225
5,326,234 A * 7/1994 Versaw et al. ..... 417/393
5,558,506 A * 9/1996 Simmons et al. ..... 417/393
6,036,445 A * 3/2000 Reynolds ..... 417/53
6,241,487 B1 * 6/2001 Reynolds ..... 417/395
6,257,845 B1 * 7/2001 Jack et al. ..... 417/395
6,280,149 B1 * 8/2001 Able et al. ..... 417/63
6,422,834 B1 * 7/2002 Bahrton ..... 417/395
2002/0076340 A1 * 6/2002 Yamada ..... 417/393

* cited by examiner

*Primary Examiner*—Charles G. Freay
*Assistant Examiner*—Emmanuel Sayoc
(74) *Attorney, Agent, or Firm*—Wenderoth, Lind & Ponack, L.L.P.

(57) ABSTRACT

A restarting device of a pump change-over valve in a pump is provided, in which the pump includes; a pump main body 1 and a change-over valve 2. The change-over valve 2 is provided with a pair of pressure chambers 31 and 32 formed at respective ends on the back face sides of a valve body 23. The driving fluid is supplied into the chambers to induce a pressure difference to switch the direction of movement of the valve body 23. Also, the pump main body 1 is provided with a balancing valve 49 whose end portions 49A and 49B face driving chambers 4A and 5A, respectively. If the change-over valve 2 malfunctions and the pressures in the two driving chambers 4B and 5B are balanced, the balancing valve 49 is held in an intermediate position and will then induce a pressure difference between the two pressure chambers 31 and 32.

6 Claims, 6 Drawing Sheets

RESTARTING DEVICE OF A PUMP CHANGE-OVER VALVE WHICH INDUCES A PRESSURE DIFFERENCE WITHIN THE PUMP CHANGE-OVER VALVE TO REMOVE THE LATTER FROM AN INTERMEDIATE STALLED POSITION

BACKGROUND OF THE INVENTION

The present invention relates to a restarting device of a pump change-over valve for restarting an operation of a pump automatically in such an event that the operation of the pump is shut down due to the change-over valve stopping in a neutral position. The change-over valve is to be moved forth and back to switch the operation of the pump.

Among prior art pumps (for example, diaphragm-type pumps), a pump comprising a pair of diaphragms has been known. The respective diaphragms partition a pump main body into fluid delivering chambers and driving chambers, respectively.

Such diaphragm-type pump has employed a certain configuration, in which when a fluid-in-transfer in a first fluid delivering chamber located at a first diaphragm side is to be discharged, a driving fluid (e.g., a compressed air) is supplied to the first driving chamber located at the first diaphragm side to increase a volume of the first driving chamber. Therefore, the volume of the first fluid delivering chamber located at the first diaphragm side is decreased, while simultaneously the driving fluid in the second driving chamber located at the second diaphragm side is exhausted to decrease the volume thereof and, thus, to increase the volume of the second fluid delivering chamber located at the second diaphragm side. As a result, the second fluid delivering chamber sucks the fluid-in-transfer.

Further, in this configuration, when the fluid-in-transfer in the second fluid delivering chamber located at the second diaphragm side is to be discharged, the driving fluid is supplied to the second driving chamber located at the second diaphragm side to increase the volume of the second driving chamber. Therefore, the volume of the second fluid delivering chamber is decreased while simultaneously the driving fluid in the one driving chamber located in the first diaphragm side is exhausted to decrease the volume thereof and, thus, increase the volume of the first fluid delivering chamber located at the first diaphragm. As a result, the first fluid delivering chamber sucks the fluid-in-transfer.

Further, this kind of diaphragm-type pump is typically provided with a change-over valve, which is to be moved forth and back to switch an operation of the pump between a first mode for discharging the fluid-in-transfer in the first fluid delivering chamber and causing the second fluid delivering chamber to suck the fluid-in-transfer, and a second mode causing the first fluid delivering chamber to suck the fluid-in-transfer and for discharging the fluid-in-transfer in the second fluid delivering chamber.

However, because there is a neutral position in this change-over valve and, disadvantageously, stopping of a valve body in the neutral position may lead to shut down of the operation of the pump, a variety of improvement has been introduced into a pump design in order to solve this problem. Such improvements include, for example, a system, based on the fact that the pressure of the fluid-in-transfer drops when the change-over valve malfunctions, that detects the pressure drop and engages the reset button to restart the change-over valve. An alternative system detects the reciprocating motion of the valve body using a metal detecting sensor, and if there is no detection signal generated in a predetermined period, the system determines that the change-over valve has malfunctioned and engages the reset button to restart the change-over valve.

However, if the fluid-in-transfer is flammable and a care must be taken to avoid an explosion, the detection using the electric system is not suitable.

Additionally, it could be hardly said that a restarting device according to the prior art has a configuration enabling the reliable detection of the malfunctioning of the change-over valve to restart the pump.

SUMMARY OF THE INVENTION

The present invention has been made in view of the above problems, and an object thereof is to provide a restarting device of the pump change-over valve for restarting an operation of the pump automatically by using the driving fluid in such an event that the operation of the pump is shut down due to the change-over valve stopping in a neutral position. The change-over valve is to be moved forth and back to switch the operation of the pump.

According to the present invention, there is provided a restarting device of a pump change-over valve in a pump, in which the pump comprises a pump main body and a change-over valve. The pump main body is operated in such a manner that, when a fluid-in-transfer in a first fluid delivering chamber is to be discharged, a driving fluid is supplied to a first driving chamber to increase a volume of the first driving chamber and, thus, decrease a volume of the first fluid delivering chamber. Simultaneously, the driving fluid in a second driving chamber is exhausted to decrease a volume thereof and, thus, increase a volume of the other fluid delivering chamber. Thus the second fluid delivering chamber sucks the fluid-in-transfer. When the fluid-in-transfer in the second fluid delivering chamber is to be discharged, the driving fluid is supplied to the second driving chamber to increase the volume of the second driving chamber and, thus, decrease the volume of the second fluid delivering chamber. Simultaneously, the driving fluid in the first driving chamber is exhausted to decrease the volume thereof and, thus, increase the volume of the first fluid delivering chamber, thereby causing the first fluid delivering chamber to suck the fluid-in-transfer.

The change-over valve is operable to make a reciprocating motion to switch the operation of the pump main body between a first mode for discharging the fluid-in-transfer in the first fluid delivering chamber while causing the second fluid delivering chamber to suck the fluid-in-transfer, and a second mode causing the first fluid delivering chamber to suck the fluid-in-transfer while discharging the fluid-in-transfer in the second fluid delivering chamber.

The change-over valve is provided with a pair of pressure chambers formed in both ends on the back face sides of its valve body, respectively, into which the driving fluid is supplied to induce a pressure difference to switch the direction of movement of the valve body. The pump main body includes a balancing valve in which both end portions face the first driving chamber and the second driving chamber, respectively, If the change-over valve malfunctions and the pressures in both driving chambers become balanced, the balancing valve is to be held in an intermediate position, and is then to induce the pressure difference between the pair of pressure chambers.

According to another embodiment of the present invention there is provided a restarting device of a pump change-over valve in a pump, in which the pump comprises a pump main body and a change-over valve. The pump main body is provided with a pair of diaphragms for defining fluid delivering chambers and driving chambers. The pump main body is operated in such a manner that, when a fluid-in-transfer in a first fluid delivering chamber located at a first diaphragm side is to be discharged, a driving fluid is supplied to a first driving chamber located at the first diaphragm side to increase a volume of the first driving chamber and, thus, decrease a volume of the first fluid delivering chamber. Simultaneously, the driving fluid in the second driving chamber located at the second diaphragm side is exhausted to decrease a volume thereof and, thus, increase a volume of a second fluid delivering chamber located at the second diaphragm side, thereby causing the second fluid delivering chamber to suck the fluid-in-transfer. When the fluid-in-transfer in the second fluid delivering chamber is to be discharged, the driving fluid is supplied to the second driving chamber to increase the volume of the second driving chamber and, thus, decrease the volume of the second fluid delivering chamber. Simultaneously, the driving fluid in the first driving chamber is exhausted to decrease the volume thereof and, thus, increase the volume of the first fluid delivering chamber thereby causing the first fluid delivering chamber to suck the fluid-in-transfer.

The change-aver valve is operable to make a reciprocating motion to switch the operation of the pump main body between a first mode for discharging the fluid-in-transfer in the first fluid delivering chamber while causing the other fluid delivering chamber to suck the fluid-in-transfer, and a second mode causing the first fluid delivering chamber to suck the fluid-in-transfer while discharging the fluid-in-transfer in the second fluid delivering chamber.

The change-over valve is provided with a pair of pressure chambers formed in both ends on the back face sides of its valve body, respectively, into which the driving fluid is supplied to induce a pressure difference to switch the direction of movement of the valve body. The pump main body is provided with a balancing valve having both end portions facing the first driving chamber and the second driving chamber, respectively. If the change-over valve malfunctions and the pressures in both driving chambers are balanced, the balancing valve is to be held in an intermediate position and is then to induce the pressure difference between the pair of pressure chambers.

The pump main body may be further provided with a pilot valve for inducing a pressure difference between the pair of pressure chambers, and a direction of movement of the pilot valve is switched by the pair of diaphragms.

The pump main body may be further provided with an exhaust path for exhausting the driving fluid in the own driving chambers toward an outside. The balancing valve is further provided with a throttle valve for throttling said exhaust path when said balancing valve is positioned in a neutral position.

DETAILED DESCRIPTION OF THE INVENTION

Figure 1:
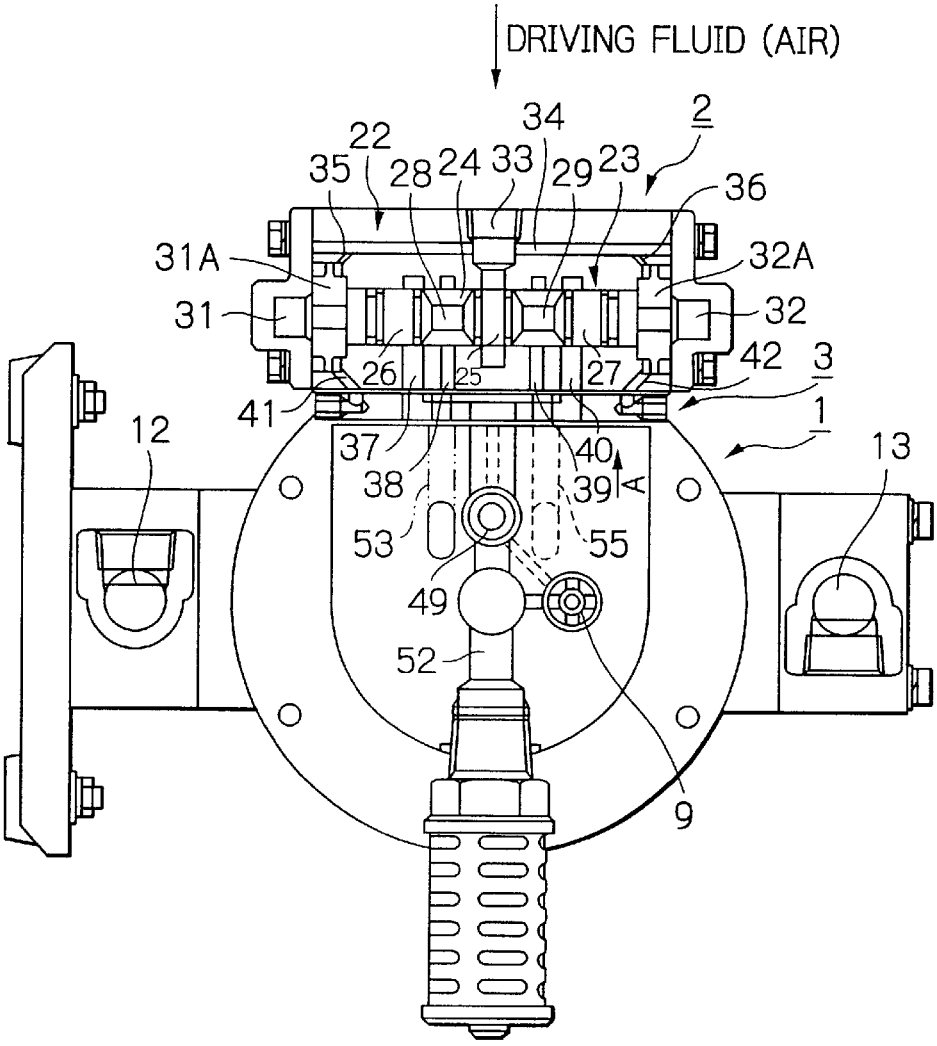
FIG. 1 is a schematic diagram of a diaphragm-type pump according to the present invention.
Figure 2:
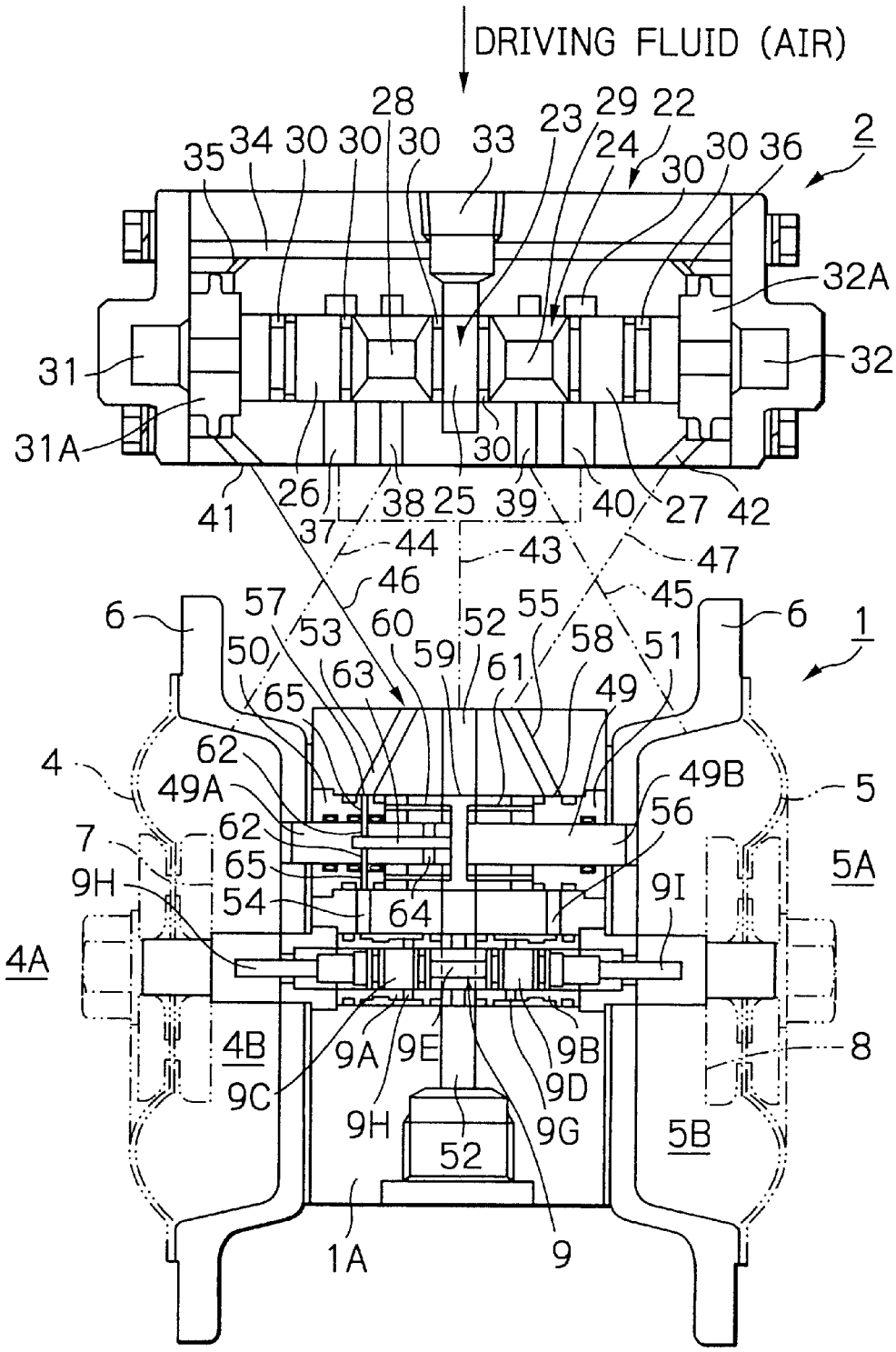
FIG. 2 is a hydraulic circuit diagram of a restarting device of a change-over valve in the diaphragm-type pump according to the present invention, illustrating the condition when the operation of the pump has shut down.
Figure 3:
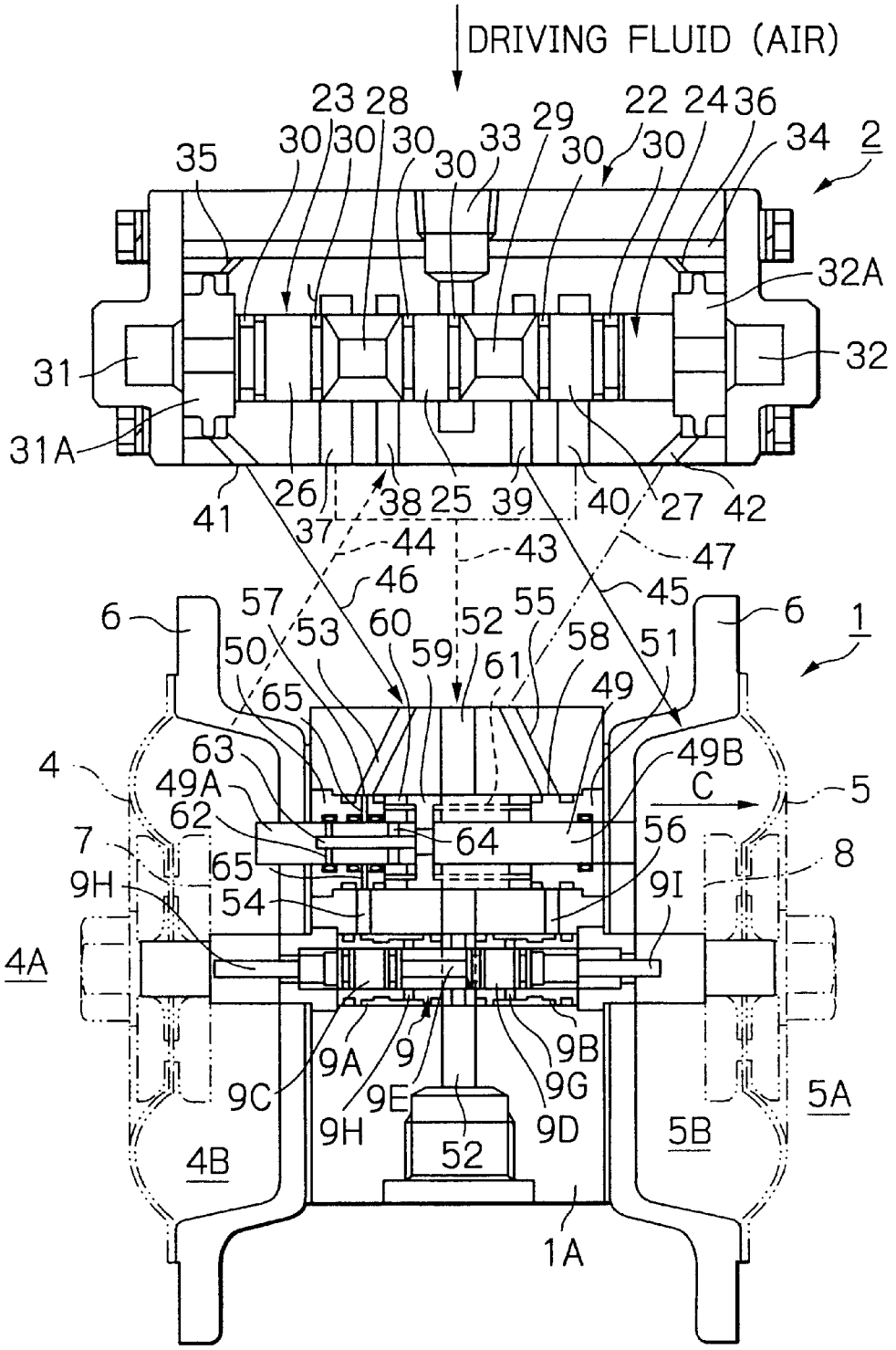
FIG. 3 is a hydraulic circuit diagram of the restarting device of the change-over valve in the diaphragm-type pump according to the present invention, illustrating the condition right after the operation of the pomp has been restarted.
Figure 4:
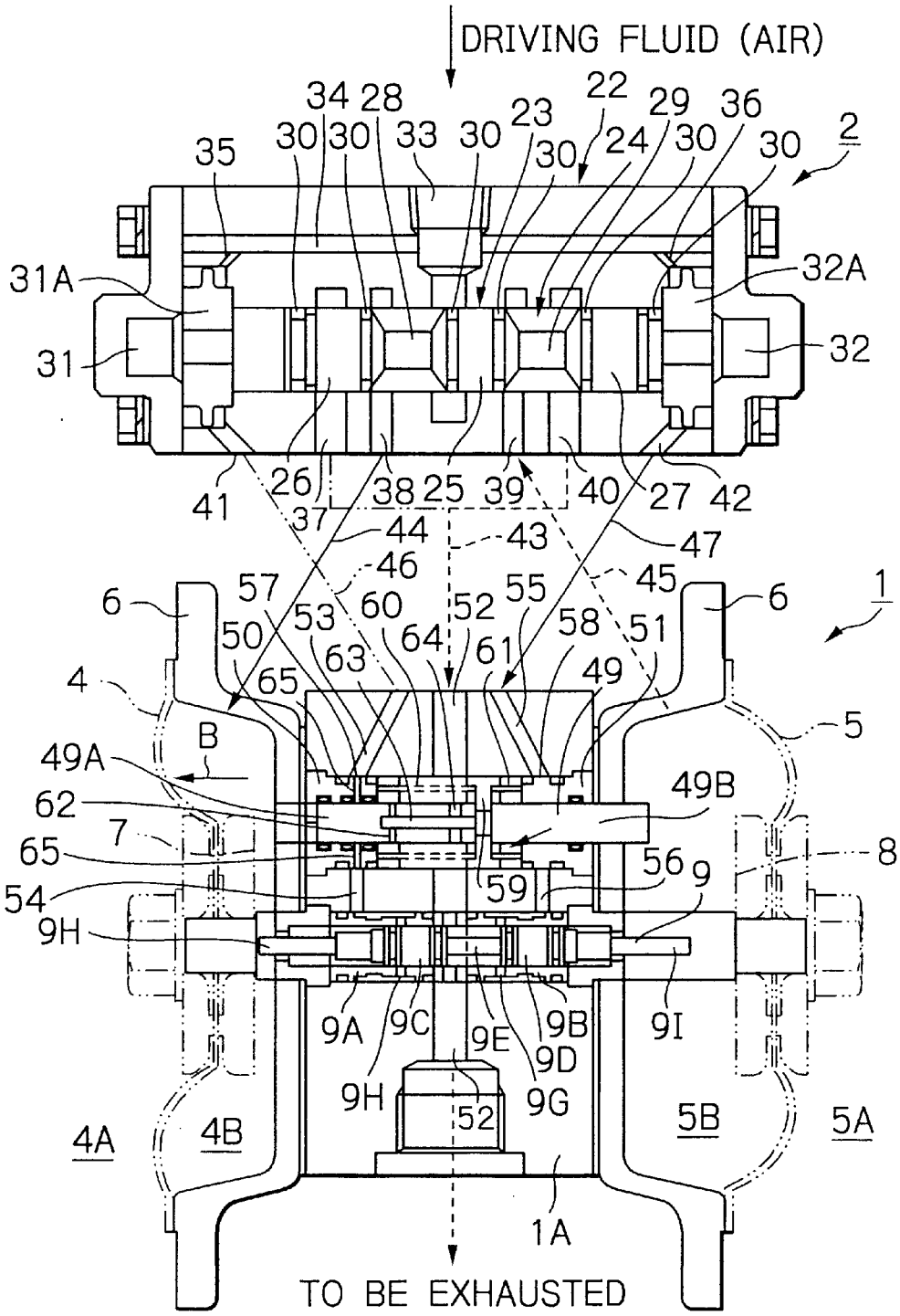
FIG. 4 is a hydraulic circuit diagram of the restarting device of the change-over valve in the diaphragm-type pump according to the present invention, illustrating the condition when the pump is normally operated.

FIG. 1 is a schematic diagram of a restarting device of a change-over valve in a diaphragm-type pump according to the present invention, and FIGS. 2 to 4 show a hydraulic circuit diagram of the restarting device of the change-over valve in the diaphragm-type pump. In FIG. 1, reference numeral 1 designates a pump main body, 2 designates a change-over valve, and 3 designates a hydraulic circuit board.

The pump main body 1 comprises a diaphragm 4 and a second diaphragm 5 disposed on respective sides thereof, as shown in FIGS. 2 to 4. Respective diaphragms 4 and 5 partition the pump main body 1 into a first fluid delivering chamber 4A and a second fluid delivering chamber 5A and first and second driving chambers 4B and 5B, respectively. Peripheral portions of these diaphragms 4 and 5 are secured to mounting portions 6 and 6 of the pump main body 1. The diaphragms 4 and 5 include first and second switching plates 7 and 8 respectively disposed in central portions thereof.

The pump main body 1 has a casing block 1A made of aluminum, which comprises a pilot valve 9 capable of moving laterally. The pilot valve 9 is slidably supported by annular members 9A and 9B.

The pilot valve 9 has diameter-expanded sections 9C and 9D with a diameter-reduced section 9E interposed therebetween. The diameter-reduced section 9E communicates with an exhaust path, which will be described later. A first communicating hole 9F is formed in the annular member 9A, and a second communicating hole 9G is formed in the annular member 9B.

A first end portion 9H of this pilot valve 9 protrudes toward the first driving chamber 4B so as to face and be able to contact the first switching plate 7, and the second end portion 9I protrudes toward the second driving chamber 5B so as to face the second switching plate 8. When the pilot valve 9 is positioned at the left hand side, the first communicating hole 9F communicates with the exhaust path which will be described later, while the second communicating hole 9G is blocked by the second diameter-expanded section 9D.

When the pilot valve 9 is positioned at the right hand side, the first communicating hole 9F is blocked by the first diameter-expanded section 9C, while the second communicating hole 9G communicates with the exhaust path which will be described later. When the pilot valve 9 is positioned in an intermediate location, the communicating holes 9F and 9G are blocked by the diameter-expanded sections 9C and 9D, respectively. This pilot valve 9 is capable of releasing a pressure in a pilot chamber (which will be described later) arranged in the change-over valve 2.

A known supply path (not shown) is arranged in one side of the pump main body 1 for supplying the fluid delivering chambers 4A and 5A with a fluid-in-transfer, and a known discharge path (not shown) is arranged in the other side of the pump main body 1 for discharging the fluid-in-transfer in the fluid delivering chambers 4A and 5A to the outside (the exterior of pump body 1). In FIG. 1, reference numeral 12 designates an inlet port for receiving the fluid-in-transfer from an external unit, and reference numeral 13 designates a discharge port for discharging the fluid-in-transfer from the discharge path to the outside.

Known suction ports (not shown) communicating with the supply path are arranged in the fluid delivering chambers 4A and 5A, respectively, while known discharge ports (not shown) communicating with the discharge path are also arranged in the fluid delivering chambers 4A and 5A, respectively. Each of those ports is provided with a known check valve (not shown) for opening or closing each of the ports.

The driving chambers 4B and 5B are to be supplied with a compressed air as a driving fluid from the change-over valve 2, as will be described in detail later, but the change-over valve 2 will be explained first. In this regard, components referred to as "left" or "right" are identified with respect to the Figures in this application (specifically FIGS. 2–4), but can also be referred to as "first" and "second", respectively.

The change-over valve 2 can switch the direction of the driving fluid to be supplied to the first driving chamber 4B or to the second driving chamber 5B. A spool valve has been employed as the change-over valve 2 in this embodiment. This change-over valve 2 has a casing block section 22 made of aluminum, and has a spool 23 as a valve body.

The casing block 22 includes an accommodation space 24 for allowing a horizontally reciprocating motion of the spool 23. The spool 23 has a central diameter-expanded section 25 in a central portion thereof, and the accommodation space 24 is partitioned by the diameter-expanded section 25 into the a left chamber and a right chamber. Left and right diameter-expanded sections 26 and 27, respectively, are formed at opposite ends of the spool 23 with a portion between the diameter-expanded sections 26 and 25 defined as a left diameter-reduced section 28 and another portion between the diameter-expanded sections 27 and 25 defined as a right diameter-reduced section 29. Each of the diameter-expanded sections 25 to 27 is provided with a sealing member 30.

The left chamber has a left pilot chamber (a pressure chamber) 31 and the right chamber has a right pilot chamber (a pressure chamber) 32. The back face of the left diameter-expanded section 26 faces the left pilot chamber 31 and the back face of the right diameter-expanded section 27 faces the pilot chamber 32. The pilot chambers 31 and 32 are provided with cushion members 31A and 32A, respectively.

A supply port 33 and a supply path 34 are formed in an upper portion of the casing block 22 for supplying the compressed air (or the air). In the casing block 22, orifices 35 and 36 are arranged in a section between the supply path 34 and the accommodation space 24, including a left orifice 35 for establishing the communication between the supply path 34 and the pilot chamber 31 and an orifice 36 for establishing the communication between the supply path 34 and the pilot chamber 32. Therefore, a small amount of the compressed air can be regularly supplied into each of the pilot chambers 31 and 32.

Ports 37 to 42 are arranged in a lower portion of the casing section 22. The ports 37 and 38 communicate with the left chamber, the ports 39 and 40 communicate with the right chamber, the port 41 communicates with the pilot chamber 31, and the port 42 communicates with the pilot chamber 32.

The port 37 is formed in such a location that the port 37 is blocked by the diameter-expanded section 26 when the spool 23 is positioned at the right hand side, and the part 40 is formed in such a location that the port 40 is blocked by the diameter-expanded section 27 when the spool 23 is positioned at the left hand side. The port 38 is formed in such a location that the port 38 communicates with the supply port 33 when the spool 23 is positioned at the right hand side and communicates with the port 37 when the spool 23 is positioned at the left hand side. The port 39 is formed in such a location that the port 39 communicates with the supply port 33 when the spool 23 is positioned at the left hand side and communicates with the port 40 when the spool 23 is positioned at the right hand side.

Figure 5:
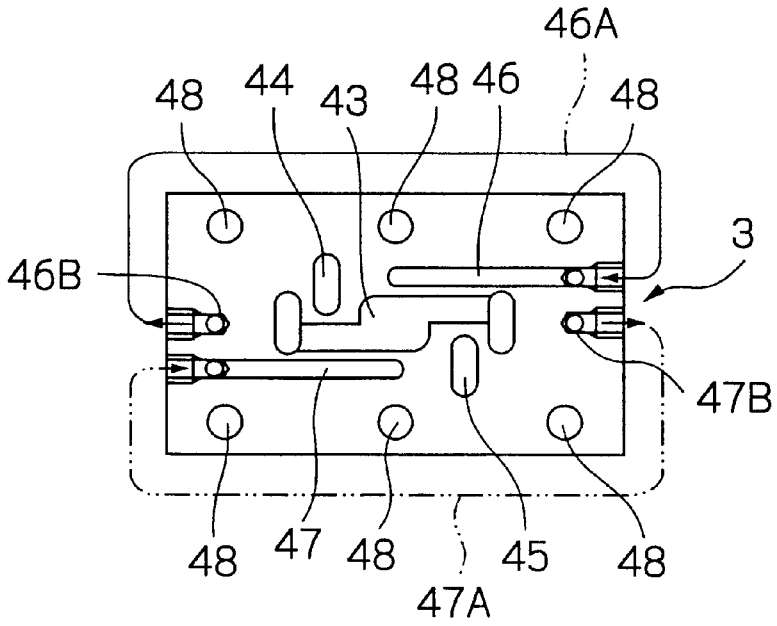
FIG. 5 shows a hydraulic circuit board shown in FIG. 1 viewed from the direction indicated by an arrow A.

Those ports 37 to 42 communicate with respective paths in the pump main body 1 via the hydraulic circuit board 3. Paths 43 to 47 are formed in the hydraulic circuit board 3, as shown in FIG. 5. The path 43 communicates with the ports 37 and 40, the path 44 communicates with the port 38, the path 45 communicates with the port 39, the path 46 communicates with the port 41 via a tube 46A, and the path 47 communicates with the port 42 via a tube 47A. In FIG. 5, reference numeral 46B designates an aperture opened to the port 41, and 47B designates an aperture opened to the port 42. This hydraulic circuit board 3 is secured between the pump main body 1 and the casing section 22 by using screws, though not shown, and reference numeral 48 designates holes through which the screws are to be inserted.

Figure 6:
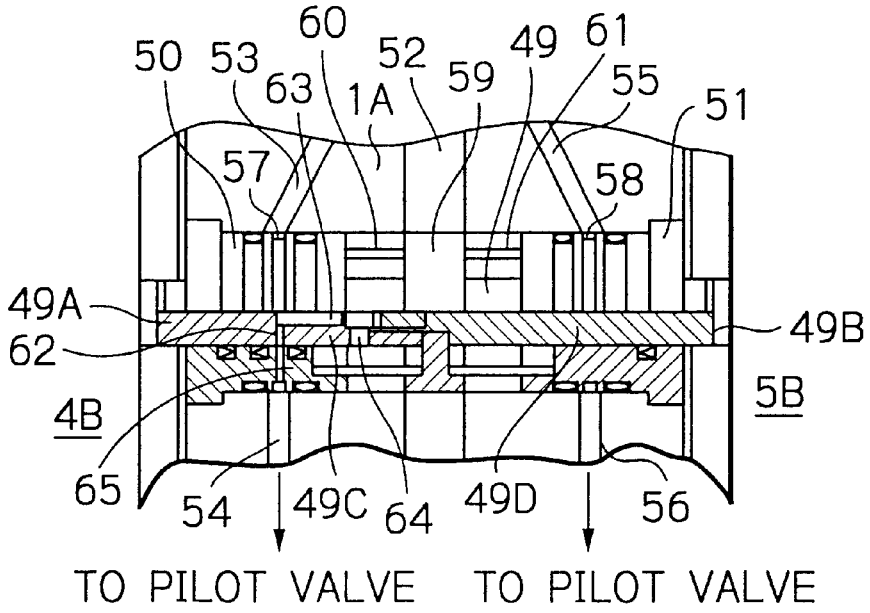
FIG. 6 is an enlarged view of a balancing valve section shown in FIG. 2, with a half of the valve illustrated in a cross sectional view.
Figure 7:
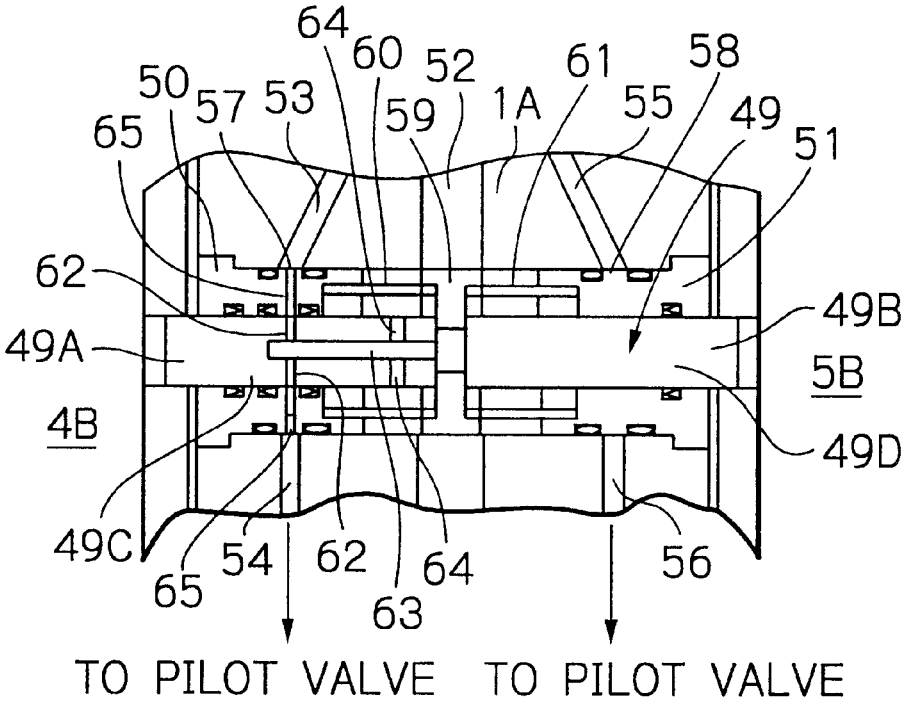
FIG. 7 is an enlarged view of the balancing valve section shown in FIG. 2, illustrated entirely in a cross sectional view.

A balancing valve 49 is arranged in the casing block 1A, and the valve 49 can move in the left or the right direction in response to a pressure difference between the driving chambers 4B and 5B. The balancing valve 49 is, as illustrated in the enlarged views of FIGS. 6 and 7, slidably supported by first and second annular members 50 and 51. A first end 49A of the balancing valve 49 faces the first driving chamber 4B so that it can protrude into the first driving chamber 4B, and the second end 49B of the balancing valve 49 faces the second driving chamber 5B so that it can protrude into the second driving chamber 5B.

In the casing block 1A, an exhaust path 52 for exhausting the driving fluid and switching channels 53 to 56 for switching the supply of the driving fluid are formed. Annular grooves 57 and 58 are formed in the annular members 50 and 51, so that the switching channel 53 communicates with the switching channel 54 via the annular groove 57, and the switching channel 55 communicates with the switching channel 56 via the annular groove 58.

The balancing valve 49 comprises a balancing valve component 49C and a balancing valve component 49D, the balancing valve component 49C and the balancing valve component 49D are joined to each other by thread to form the balancing valve 49. The balancing valve 49 is provided with an annular throttle valve 59 disposed in the center thereof for throttling the exhaust path 52. This annular throttle valve 59 is fixedly held while the balancing valve component 49C and the balancing valve component 49D are fastened to each other by thread.

Bias springs 60 and 61 are arranged between the annular throttle valve 59 and respective annular members 50 and 51, and the bias springs 60 and 61 function to bias the balancing valve 49 in the opposite directions, respectively.

A relief hole 62 extending radially, an axial hole 63 extending axially and another relief hole 64 extending radially are formed in the balancing valve 49. The relief hole 62 communicates with the relief hole 64 via the axial hole 63. The relief hole 64 communicates with the exhaust path 52.

A communicating hole 65 communicating with the annular groove 57 is formed in the annular member 50. When the pressures in the driving chambers 4B and 5B are balanced so that the balancing valve 49 is positioned in the center point, the relief hole 62 communicates with the communicating hole 65, as shown in FIG. 2.

An operation of the diaphragm-type pump according to the present invention will now be described below.

FIG. 4 shows the diaphragm-type pump in a normal operation, illustrating a condition immediately after the spool 23 has been positioned at the right hand side and the compressed air has been supplied through the port 38, the path 44, and into the first driving chamber 4B.

Additionally, the pilot valve 9 has been positioned at the right hand side so that the communicating hole 9G communicates with the exhaust path 52, and the compressed air in the pilot chamber 32 has been exhausted outside the pump via the port 42, the path 47, the switching channel 55, the annular groove 58, the switching channel 56 and the communicating hole 9G, thereby maintaining the differential pressure between the pressure chamber 31 and the pressure chamber 32.

In this condition, the first diaphragm 4 is now moved in the direction indicated by the arrow B so as to increase the volume of the first driving chamber 4B and thus decrease the volume of the first fluid delivering chamber 4A. Thus, the fluid-in-transfer within the first fluid delivering chamber 4A is discharged from the discharge port 13 to the outside of the pump.

Meanwhile, since the port 40 and the port 39 communicate with each other, the compressed air in the second driving chamber 5B is guided through the path 45, the port 39, the port 40, and the path 43 to the exhaust path 52 and then exhausted to the outside of the pump.

This decreases the volume of the second driving chamber 5B and increases the volume of the second fluid delivering chamber 5A, so that the fluid-in-transfer is sucked from the inlet port 12 into the second fluid delivering chamber 5A. Further, since the pressure in the first driving chamber 4B becomes higher than that in the second driving chamber 5B, the balancing valve 49 is held at the right hand side, and the annular throttle valve 59 is held in a condition where the annular throttle valve 59 has been retracted from the exhaust path 52. Accordingly, the communication between the communicating hole 65 and the relief hole 62 is blocked, and at the same time, the communicating hole 9F is blocked by the diameter-expanded section 9C, so that the pressure level of the compressed air in the pilot chamber 31 is maintained.

As the volume of the second driving chamber 5B decreases and the switching plate 8 contacts the second end 9I of the pilot valve 9, the pilot valve 9 is moved in the leftward direction. When the pilot valve 9 has reached the terminal end of its moving stroke, the communicating hole 9G is blocked by the second diameter-expanded section 9D and the first diameter-expanded section 9C is retracted from the position where the first diameter-expanded section 9C blocks the communicating hole 9F. Thus, the communicating hole 9F is opened, so that the compressed air in the pilot chamber 31 is guided through the port 41, the path 46, the switching channel 53, the annular groove 57, the switching channel 54, and the communicating hole 9F to the exhaust path 52, and is thus exhausted outside the pump.

This induces a pressure difference between the pilot chamber 31 and the pilot chamber 32, which in turn moves the spool 23 in the leftward direction. Then the compressed air is supplied to the second driving chamber 5B through the port 39 and the path 45, so that the second diaphragm 5 is moved in the direction indicated by the arrow C (see FIG. 3) to increase the volume of the second driving chamber 5B and to decrease the volume of the second fluid delivering chamber 5A. Accordingly, the fluid-in-transfer in the fluid delivering chamber 5A is discharged from the discharge port 13. On the other hand, the compressed air in the first driving chamber 4B is exhausted outside the pump via the path 44, the port 38, the port 37, the path 43, and the exhaust path 52. This decreases the volume of the first driving chamber 4B and increases the volume of the first fluid delivering chamber 4A. As a result, the fluid-in-transfer is sucked from the inlet port 12 into the first fluid delivering chamber 4A. Further, since the pressure in the second driving chamber 5B becomes higher than the pressure in the first driving chamber 4B, the balancing valve 49 is moved in the rightward direction.

If the diaphragm-type pump stopped its operation, the pressure in the first driving chamber 4B would be balanced with the pressure in the second driving chamber 5B and so the balancing valve 49 would be held in the neutral position, as shown in FIG. 2. In this condition shown in FIG. 2, the annular throttle valve 59 is in a position to almost completely block the exhaust path 52, so that the exhausting of the compressed air via the ports 37, 40 and the path 43 is inhibited, while the volume of the compressed air to be supplied to the pilot chambers 31 and 32 via the orifices 35 and 36 is increased.

However, since the relief hole 62 communicates with the communicating hole 65, the compressed air in the pilot chamber 31 is guided through the port 41, the path 46, the switching channel 53, the communicating hole 65, the relief hole 62, the axial hole 63 and the relief hole 64 to the exhaust path 52, so as to release the pressure in the pilot chamber 31.

This induces a pressure difference between the pilot chamber 31 and the pilot chamber 32, which causes the spool 23 to be moved in the leftward direction to permit communication between the port 37 and the port 38, as shown in FIG. 3. Further, the port 39 is opened.

Accordingly, the compressed air flows through the port 39 and the path 45 to be supplied to the second driving chamber 5B, and the second diaphragm 5 is moved in the direction indicated by the arrow C. Meanwhile, the compressed air in the first driving chamber 4B is guided through the path 44, the ports 38, 37 and the path 43 to the exhaust path 52, so as to be exhausted outside the pump. Also, since the pressure in the second driving chamber 5B is increased to a higher level than the pressure in the first driving chamber 4B, the pilot valve 9 and the balancing valve 49 are moved in the leftward direction to trigger the restarting of the pump main body 1, thereby resetting the pump back to the normal operating mode.

It is to be noted that the reason why the annular throttle valve 59 has been employed is that in the event of the spool 23 stopping in the neutral position, the annular throttle valve 59 will prevent the compressed air supplied through the supply port 33 from being exhausted directly to the exhaust path 52 via, depending on the slopping position of said spool 23, the port 40 or the port 37. Consequently, the supply of the compressed air to the pilot chambers 31 and 32 is increased.

The present invention has been described above with an embodiment applied to the a diaphragm-type pump. It should be understood, however, that the present invention may be applicable to such a change-over valve which controls the fluid in multi-directions (e.g., in two-way, three-way and so forth).

According to the present invention, even if the operation of a pump is shut down due to a change-over valve stopping in the neutral position, which valve has been moving forth and back to switch the operation of the pump, the operation of the pump can be restarted certainly and automatically. In particular, according to the present invention,. since the pump can be restarted automatically only based on a pressure difference in the driving fluid, the present invention may provide significant safety and effectiveness in the case if the fluid-in-transfer is flammable liquid.

What is claimed is:

1. A pump comprising:

a pump main body including a first fluid delivering chamber, a first driving chamber, a second fluid delivering chamber, a second driving chamber, and a balancing valve having a first end facing said first driving chamber and having a second end facing said second driving chamber; and a change-over valve communicating with said pump main body, and including a supply port for receiving a driving fluid, a first pressure chamber at a first end of said change-over valve, a second pressure chamber at a second end of said change-over valve opposite said first end, and a valve body operable to reciprocate between said first pressure chamber and said second pressure chamber based on a difference between a pressure of the driving fluid in said first pressure chamber and a pressure of the driving fluid in said second pressure chamber, said change-over valve being operable to shift an operation of said pump main body between a first mode and a second mode by controlling a supply of the driving fluid to said pump main body and by controlling an exhaust of the driving fluid from said pump main body, said pump main body and said change-over valve being arranged such that in the first mode:

a volume of said first driving chamber is increased by supplying the driving fluid to said first driving chamber, thereby decreasing a volume of said first fluid delivering chamber so as to discharge a fluid-in-transfer from said first fluid delivering chamber; and simultaneously a volume of said second driving chamber is decreased by exhausting the driving fluid from said second driving chamber, thereby increasing a volume of said second fluid delivering chamber so as to suck the fluid-in-transfer into said second fluid delivering chamber;

said pump main body and said change-over valve being arranged such that in the second mode;

a volume of said second driving chamber is increased by supplying the driving fluid to said second driving chamber, thereby decreasing a volume of said second fluid delivering chamber so as to discharge a fluid-in-transfer from said second fluid delivering chamber; and simultaneously a volume of said first driving chamber is decreased by exhausting the driving fluid from said first driving chamber, thereby increasing a volume of said first fluid delivering chamber so as to suck the fluid-in-transfer into said first fluid delivering chamber; and wherein said pump main body and said change-over valve are further arranged such that if said change-over valve remains in an intermediate position so that pressures in said first driving chamber and said second driving chamber of said pump main body are substantially identical, said balancing valve of said pump main body is operable to induce a pressure difference between said first pressure chamber and said second pressure chamber of said change-over valve so that said change-over valve moves from said intermediate position.

2. The pump of claim 1, wherein said pump main body further includes a first pumping chamber having a first diaphragm arranged therein, and including a second pumping chamber having a second diaphragm arranged therein, said first fluid delivering chamber and said first driving chamber being arranged in said first pumping chamber so as to be separated by said first diaphragm, and said second fluid delivering chamber and said second driving chamber being arranged in said second pumping chamber so as to be separated by said second diaphragm.

3. A pump comprising:

a pump main body including a first fluid delivering chamber, a first driving chamber, a first diaphragm separating said first fluid delivering chamber from said first driving chamber, a second fluid delivering chamber, a second driving chamber, a second diaphragm separating said second fluid delivering chamber from said second driving chamber, and a balancing valve having a first end facing said first driving chamber and having a second end facing said second driving chamber; and a change-over valve communicating with said pump main body, and including a supply port for receiving a driving fluid, a first pressure chamber at a first end of said change-over valve, a second pressure chamber at a second end of said change-over valve opposite said first end, and a valve body operable to reciprocate between said first pressure chamber and said second pressure chamber based on a difference between a pressure of the driving fluid in said first pressure chamber and a pressure of the driving fluid in said second pressure chamber, said change-over valve being operable to shift an operation of said pump main body between a first mode and a second mode by controlling a supply of the driving fluid to said pump main body and by controlling an exhaust of the driving fluid from said pump main body, said pump main body and said change-over valve being arranged such that in the first mode;

a volume of said first driving chamber is increased by supplying the driving fluid to said first driving chamber, thereby pushing said first diaphragm so as to decrease a volume of said first fluid delivering chamber and thereby discharge a fluid-in-transfer from said first fluid delivering chamber; and simultaneously a volume of said second driving chamber is decreased by exhausting the driving fluid from said second driving chamber, thereby pulling said second diaphragm so as to increase a volume of said second fluid delivering chamber and thereby suck the fluid-in-transfer into said second fluid delivering chamber;

said pump main body and said change-over valve being arranged such that in the second mode;

a volume of said second driving chamber is increased by supplying the driving fluid to said second driving chamber, thereby pushing said second diaphragm so as to decrease a volume of said second fluid delivering chamber and thereby discharge a fluid-in-transfer from said second fluid delivering chamber; and simultaneously a volume of said first driving chamber is decreased by exhausting the driving fluid from said first driving chamber, thereby pulling said second diaphragm so as to increase a volume of said first fluid delivering chamber and thereby suck the fluid-in-transfer into said first fluid delivering chamber; and wherein said pump main body and said change-over valve are further arranged such that if said change-over valve remains in an intermediate position so that pressures in said first driving chamber and said second driving chamber of said pump main body are substantially identical, said balancing valve of said pump main body is operable to induce a pressure difference between said first pressure chamber and said second pressure chamber of said change-over valve so that said change-over valve moves from said intermediate position.

4. The pump of claim 3, wherein said pump main body further includes a first pumping chamber having said first fluid delivering chamber, said first driving chamber, and said first diaphragm arranged therein, and including a second pumping chamber having said second fluid delivering chamber, said second driving chamber, and said second diaphragm arranged therein.

5. The pump of claim 3, wherein said pump main body further includes a pilot valve communicating with said balancing valve to induce the pressure difference between said first pressure chamber and said second pressure chamber of said change-over valve, a direction of movement of said pilot valve being controlled by said first diaphragm and said second diaphragm.

6. The pump of claim 5, wherein said pump main body further includes an exhaust path for guiding exhaust of the driving fluid from said first driving chamber and said second driving chamber to an exterior of said pump, and said balancing valve including a throttle valve for throttling the exhaust guided by said exhaust path when said balancing valve is in a neutral position.

* * * * *